United States Patent [19]

Yamaoka

[11] 4,155,029

[45] May 15, 1979

[54] AUXILIARY ELECTRONIC FLASH APPARATUS

[75] Inventor: Tetsuo Yamaoka, Osaka, Japan

[73] Assignee: West Electric Co., Ltd., Osaka, Japan

[21] Appl. No.: 885,761

[22] Filed: Mar. 13, 1978

[30] Foreign Application Priority Data

Mar. 18, 1977 [JP] Japan ..... 52-30982

[51] Int. Cl.[2] ..... H05B 41/32

[52] U.S. Cl. ..... 315/151; 315/153; 315/155; 315/159; 315/241 P; 315/324; 354/131; 354/145; 250/214 SF

[58] Field of Search ..... 315/151, 153, 155, 156, 315/159, 241 P, 324; 354/33, 60 F, 131, 145; 250/214 SF

[56] References Cited

U.S. PATENT DOCUMENTS

| | | | |
|---|---|---|---|
| 3,636,406 | 1/1972 | Ackermann | 315/151 X |
| 3,868,701 | 2/1975 | Kawasaki | 354/33 |
| 3,944,877 | 3/1976 | Sato | 315/241 P |

*Primary Examiner*—Eugene R. LaRoche

*Attorney, Agent, or Firm*—Burgess, Ryan and Wayne

[57] ABSTRACT

An auxiliary electronic flash apparatus coactuable with a main electronic flash apparatus of the type having a first flash lamp for converting the energy stored on a first main capacitor into light for illuminating a subject, and a control circuit for turning off the first flash lamp when the light emitted from the first flash lamp and reflected back from the subject reaches a predetermined amount. The auxiliary electronic flash apparatus includes a photometric circuit responsive only to the light emitted from the first flash lamp within a predetermined light wavelength range for generating a flash start signal in response to which a second flash lamp in the auxiliary electronic flash apparatus is turned on and for generating a flash and signal in response to which the second flash lamp is turned off.

4 Claims, 5 Drawing Figures

1 SPECTRAL-ENERGY DISTRIBUTION CURVE FOR FLASH LAMP 40

2 RELATIVE RESPONSE OF PHOTOSENSOR 20

3 TRANSMISSION CHARACTERISTIC CURVE FOR OPTICAL FILTER 22

AUXILIARY ELECTRONIC FLASH APPARATUS

BACKGROUND OF THE INVENTION

The present invention relates to an electronic flash appratus used as an artificial source of light for taking photographs, and more particularly an auxiliary electronic flash apparatus which may be used with a main electronic flash apparatus in order to prevent underexposure or to eliminate shadows caused when only the main electronic flash apparatus is used.

When a flash exposure is made with only one electronic flash apparatus, a shadow of a subject is caused on a wall when the subject is standing close to it, depending upon the angle of illumination. In order to eliminate this shadow, an auxiliary or additional electronic flash apparatus is used. Furthermore an auxiliary electronic flash apparatus is used in order to supplement the flash light emitted from the main electronic flash apparatus when the intensity of said light is not sufficient.

When one or more auxiliary electronic flash units are used in addition to a main electronic flash apparatus. The user must set the exposure value of the camera based upon his experience and sixth-sense depending upon photographic conditions, often resulting in underexposure or an overexposure. That is, an optimun exposure rarely obtained under such conditions.

SUMMARY OF THE INVENTION

Accordingly, one of the objects of the pesent invention is to provide an auxiliary electronic flash apparatus which may be coactuable with a main electronic flash apparatus of the type including means for controlling the flash duration of a flash lamp depending upon an amount of light reflected back from a subject, whereby an underexposure or an overexposure may be avoided.

To the above and other ends, briefly stated the present invention provides an auxiliary electronic flash apparatus which is coactuable with a main electronic flash apparatus of the type including a first flash lamp capable of converting the energy stored on a first main capacitor into a flash of light for illuminating a subject, a first photometric circuit for receiving the light reflected back from the subject and a first control means or circuit which is activated when the light received by the first photometric circuit reaches a predetermined amount, thereby causing the first flash lamp to be turned off and which includes a flash unit including a second flash lamp capable of converting the energy stored on a second main capacitor into a flash of light, the spectral range of the light emitted from the second flash lamp being within a part of the spectral range of the light emitted from the first flash lamp, a second photometric circuit responsive only to the light emitted from the first flash lamp for generating an output signal representative of the start of the flash duration of the first flash lamp and an output signal representative of the end of the flash duration, a trigger circuit responsive to the start output signal from the second photometric circuit for causing the second flash lamp to turn on, and a second control circuit responsive to the flash end output signal from the second photometric circuit for causing the second flash lamp to be turned off.

Figure 3:
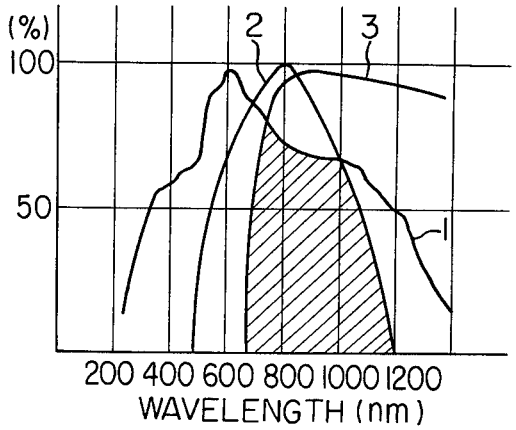

FIG. *2a* shows a transmission characteristic curve of an optical filter placed in front of a flash lamp of the auxiliary electronic flash apparatus;

FIG. *2b* shows a transmission characteristic curve of an optical filter placed in front of a photosensor of the auxiliary electronic flash apparatus;

FIG. *2c* shows a spectral responsive curve of a photosensor in the main electronic flash apparatus; and FIG. 3 shows a range of wavelengths of light received by the photosensor of the auxiliary electronic flash apparatus.

DESCRIPTION OF THE PREFERRED EMBODIMENT

Figure 1:
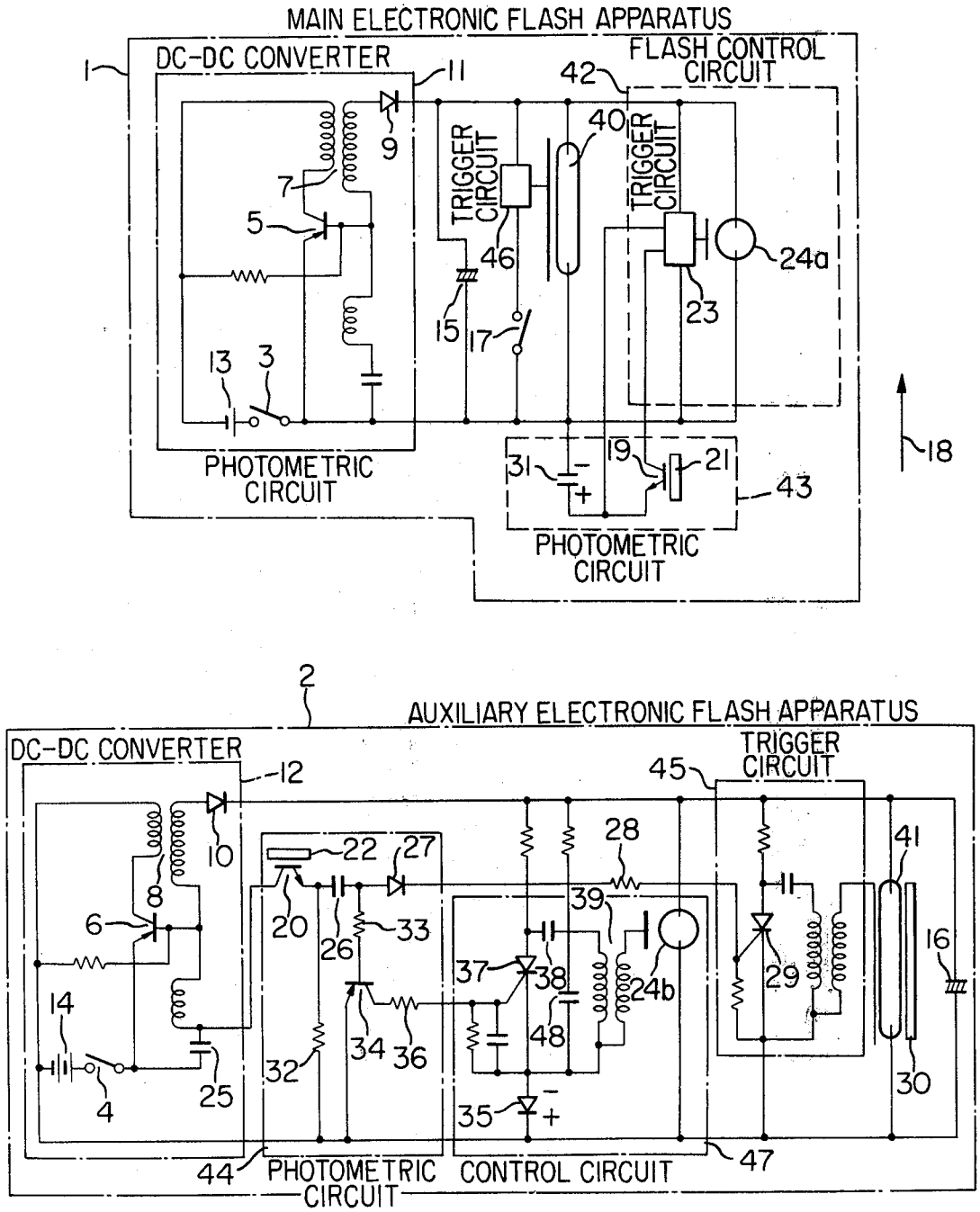
FIG. 1 is circuit diagrams of a main electronic flash apparatus and an auxiliary electronic flash apparatus in accordance with the present invention which may be coactuable with the main electronic flash apparatus.

Referring FIG. 1, a main electronic flash apparatus generally indicated by the reference numeral 1 comprises in general a DC-DC converter 11 for stepping up a DC voltage supplied from a DC power source 13 and converting it back into DC, a main capacitor 15, a flash lamp 40, a trigger circuit 46 of a conventional type, a photometric circuit 43 for receiving the light reflected back from a subject and a flash control circuit 42 for controlling the flash duration.

An auxiliary electronic flash apparatus generally indicated by the reference numeral 2 and used for compensating the underexposure with the main electronic flash apparatus 1 and/or eliminating the shadows of the subject caused by the flash light from the main electronic flash apparatus 1, comprises in general a DC-DC converter 12 similar in construction and operation to the DC-DC converter 11 in the main electronic flash apparatus 1, a main capacitor 16, a flash lamp 41, a photometric circuit 44 responsive to the flash light produced by the main electronic flash apparatus 1, a trigger circuit 45 responsive to the output from the photometric circuit 44 for generating trigger pulses for activating the flash lamp 41, and a control circuit 47 responsive to the output from the photometric circuit 44 for controlling the flash duration.

An optical band-pass filter 30 is placed in front of the flash lamp 41 in the auxiliary electronic flash apparatus 2 so that only the light in a visible light wavelength range may be transmitted. The transmission characteristic curve of the optical filter 30 is shown in FIG. *2a*. An optical high-pass filter 22 is placed in front of a photosensor or a phototransistor 20 so that only the light in the infrared region may be transmitted. The transmission characteristic curve of the optical filter 22 is shown in FIG. *2b*. Therefore the phototransistor 20 is responsive to the flash light emitted from the flash lamp 40 in the main electronic flash apparatus 1 but is not responsive to the flash light emitter from the flash lamp 41. An optical, band-pass filter 21 with a light transmission characteristic substantially similar to that of the optical filter 30 (See FIG. *2a*) is placed in front of a photosensor or a phototransistor 19 in the main electronic flash apparatus 1. In general, the radiation energy in the infrared and ultraviolet regions emitted from the flash lamp 40 or 41 is so low that the operation of the phototransistor 19 is not adversely affected in practice, but the placement of this optical filter 21 in front of the phototransistor 19 brings about an advantage that the flash duration may be precisely controlled based upon the sensitivity of a film used.

Next the mode of operation of the main and auxiliary electronic flash units 1 and 2 with the above construction will be described. First, power switches 3 and 4 in both the main and auxiliary electronic flash apparatuses 1 and 2 are closed. Then the DC-DC converter 11 or 12 consisting of a transistor 5 or 6, a transformer 7 or 8 and a diode 9 and 10 is activated so that the main capacitor 15 and 16 is charged. When a switch 17 is closed in synchronism with the shutter release operation, the trigger circuit 46 is activated to impress the trigger pulses on an external terminal of the flash lamp 40, whereby the flash lamp 40 is lighted.

Of the light reflected back from the subject 18, the optical filter 22 in the auxiliary electronic flash apparatus 2 permits the transmission of the light of wavelengths higher than about 750 nm (see FIG. 2*b*) to the phototransistor 20. Once the phototransistor 20 is enabled so that the current flows from a power source 14 through a capacitor 25, the phototransistor 20, a capacitor 26, a diode 27 and a resistor 28 to the gate of a silicon controlled rectifier SCR 29, whereby the SCR 29 is enabled. As a result the trigger circuit 45 is activated so that the main capacitor 16 discharges through the flash lamp 41, whereby the subject 18 is also illuminted from the flash light emitted from the flash lamp 41.

Of the flash light emitted from the flash lamp 41, the optical, band-pass filter 30 placed in front of the flash lamp 41 transmits the light of wavelengths approximately between 320 and 750 μm. That is, the subject 18 is illuminated with the light in the visible range emitted from the auxiliary electronic flash apparatus 2.

Of the light emitted from the flash lamps 40 and 41 in the main and auxiliary electronic flash apparatuses 1 and 2, the optical band-pass filter 21 placed in front of the phototransistor 19 permits the transmission of the light only in the range between 300 and 800 μm to the phototransistor 19. When the phototransistor 19 is enabled an integrating capacitor 31 is charged. When the voltage across the integrating capacitor 31 reches a predetermined level, a trigger circuit 23 as shown in U.S. Pat. No. 3,869,642 is activated so that the main capacitor 15 is discharged not through the flash lamp 40 but through a bypass tube 24*a*, whereby the flash lamp 40 is turned off.

Figure 2A:
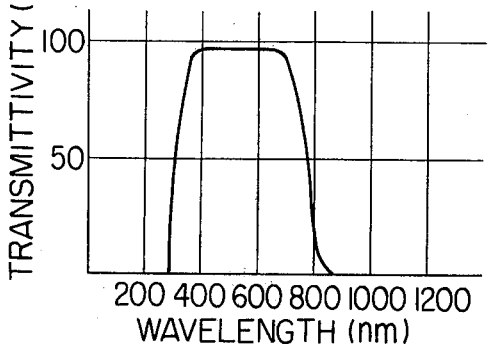
Figure 2C:
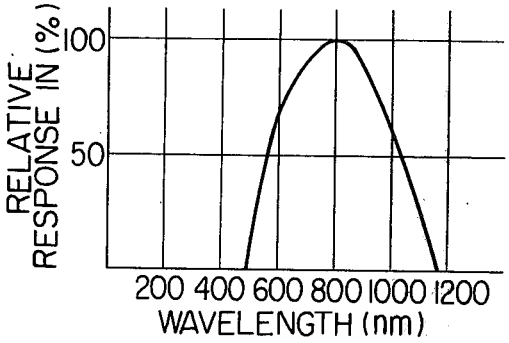
Figure 2B:
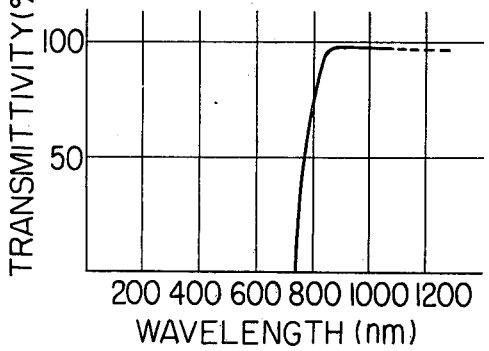

Because of the spectral response shown in FIG. 2*c* of the phototransistor 20, the transmission characteristic of the optical band-pass filter 22 shown in FIG. 2*b* and the spectral characteristic of the flash lamp 40, the phototransistor 20 receives the light in the wavelength range shown in FIG. 3. In other words, the phototransistor 20 is completely immune to the flash light emitted from the flash lamp 41 of the auxiliary electronic flash apparatus 2, but is responsive only to the light in the infrared region of the flash light emitted from the flash lamp 40 of the main electronic flash apparatus 1 and reflected back from the subject 18. When the phototransistor 20 is enabled, the capacitor 26 is charged. After the flash lamp 40 of the main electronic flash apparatus 1 has been turned off, the phototransistor 20 will not receive the infrared so that it is disabled. As a result the capacitor 26 is discharged through a resistor 32, the emitter and base of a transistor 34 and a base resistor 33 so that the trnsistor 36 is enabled.

A capacitor 48 is discharged through the flash lamp 41 and a zener diode 35 as soon as the flash lamp 41 has been lighted, and due to the voltage with polarities shown across the zener diode 35, the current flows into the gate of a SCR 37 through the transistor 34 and a resistor 36 so that the SCR 37 is enabled. As a result a capacitor 38 is discharged through a primary of a trigger transformer 39 so that a high voltage is induced across its secondary and consequently a bypass tube 24*b* is conducted. As a consequence, the main capacitor 16 is short-circuited so that the flash lamp 41 is turned off.

Since the flash lamp 41 of the auxiliary electronic flash apparatus 2 is turned on and off in response to the on and off of the flash lamp 40 of the main electronic flash apparatus in the manner described above, an optimum flash exposure may be always ensured.

So far the optical filters 21, 22 and 30 have been described as having the transmission characteristic curves as shown in FIGS. 2*a* and 2*b*, but it is apparent to those skilled in the art that optical filters having suitable transmission characteristics may be employed depending upon the sensitivity of a film used.

When the photosensors or phototransistors 19 and 20 are responsive only to the light transmitted through the optical filters 21 and 22, these filters 21 and 22 may be eliminated. When rare gases contained in the flash lamp 41 and the materials of the coating thereof are so selected that the flash lamp 41 may emit the light in the wavelength shown in FIG. 2*a*, the optical filter 30 in front of the flash lamp 41 may be also eliminated.

So far both the flash lamps 40 and 41 have been described as being turned off by short-circuiting the main capacitors 15 and 16 through the bypassing tubes 24*a* and 24*b*, but it will be understood that any other suitable means for turning off flash lamps may be employed. For instance, as disclosed in U.S. Pat. No. Re. 28,025, the flash duration of the flash lamp may be controlled by a switching element connected in parallel with the flash lamp. What is claimed is:

1. An auxiliary electronic flash apparatus actuable in response to the activation of a main electronic flash apparatus of the type including a first flash lamp for converting the energy stored on a first main capacitor into light for illuminating a subject to be photographed, a first photometric circuit for receiving the light reflected from said subject, and a first control circuit responsive to the output from said first photometric circuit for turning off said first flash lamp when the amount of the reflected light received reaches a predetermined level, said auxiliary electronic flash apparatus comprising a flash light emitting unit including a second flash lamp for converting the energy stored on a second main capacitor into light for illuminating said subject, the wavelength range of said light emitted from said second flash lamp being within a part of the wavelength range of the light emitted from said first flash lamp; a second photometric circuit responsive only to the light emitted from said first flash lamp for generating the output signals representative of the start and the end of the flash duration of said first flash lamp; a trigger circuit responsive to said start output signal from said second photometric circuit for activating said second flash lamp; and a second control circuit responsive to said end output signal from said second photometric circuit for turning off said second flash lamp.

2. An auxiliary electronic flash apparatus as set forth in claim 1 wherein said second flash lamp includes an optical filter which may transmit the light emitted from said flash lamp within a light wavelength range which corresponds to a desired part of the light wavelength range of the light emitted from said first flash lamp.

3. An auxiliary electronic flash apparatus as set forth in claim 1 wherein said second photometric circuit includes an optical filter which transmits the light emitted from said first flash lamp within a predetermined wavelength range, a photosensor responsive to the light transmitted through said optical filter, and a signal generating circuit for generating said flash start output signal when said photosensor receives the light which has been transmitted through said optical filter and for generating said flash end output signal when no light is incident upon said photosensor.

4. An auxiliary electronic flash apparatus as set forth in claim 1 wherein said second photometric circuit includes a photosensor resposive to the light emitted from said first flash lamp and reflected back from said subject, and a signal generating circuit for generating said flash start output signal when said photosensor senses said light and for generating said flash end output signal when no light is incident upon said photosensor.

* * * * *